United States Patent [19]

Komatsu

[11] 4,073,233

[45] Feb. 14, 1978

[54] PRINT POSITION ADJUSTING APPARATUS FOR ADDRESS PRINTER

[75] Inventor: Sadaharu Komatsu, Fuchu, Japan

[73] Assignee: Scriptomatic, Inc., Philadelphia, Pa.

[21] Appl. No.: 740,105

[22] Filed: Nov. 9, 1976

[30] Foreign Application Priority Data

May 31, 1976 Japan ..... 51-063095

[51] Int. Cl.[2] ..... R41L 11/08

[52] U.S. Cl. ..... 101/132.5; 64/24

[58] Field of Search ..... 101/130, 131, 131.5, 101/132, 132.5, 141, 142, 216, 217, 245; 64/24

[56] References Cited

U.S. PATENT DOCUMENTS

| | | | |
|---|---|---|---|
| 2,830,535 | 4/1958 | Williams | 101/132.5 |
| 2,888,874 | 6/1959 | Niesen et al. | 101/132.5 |
| 3,238,868 | 3/1966 | Ritzerfeld et al. | 101/132.5 X |
| 3,324,792 | 6/1967 | Watson et al. | 101/132.5 |
| 3,547,027 | 12/1970 | Gombault | 101/53 |
| 3,587,250 | 6/1971 | Raskhodoff | 64/24 |
| 3,807,303 | 4/1974 | Petersen | 101/132.5 |
| 3,996,854 | 12/1976 | Shephera | 101/132.5 |

*Primary Examiner*—Ralph T. Rader
*Attorney, Agent, or Firm*—John W. Logan, Jr.

[57] ABSTRACT

The preferred embodiment of the invention disclosed herein is an address printer including roller means for feeding a workpiece, for example, an envelope, on which printed material is to be duplicated, liquid application roller means for applying a copying liquid on the workpiece being fed and delivery means for delivering a master card on which the printed material, for example, an address, to be printed is contained. Both the workpiece and the master card are delivered to print rollers which print the printed material from the master card on the workpiece. Also included is a drive shaft for rotating the roller means and also an operating shaft arranged to operate the liquid application roller means and the delivery means. Coupling means adjustably connects the drive shaft to the operating shaft whereby the operation of the liquid application roller means and delivery means can be adjusted relative to the feed roller means so that the location of the print position on the workpiece can be adjusted.

1 Claim, 4 Drawing Figures

PRINT POSITION ADJUSTING APPARATUS FOR ADDRESS PRINTER

This invention relates to print duplicating apparatus and, more particularly, to an address printer including print position adjusting apparatus which matches the feeding of a workpiece on which the address is to be printed and the delivery of a master card carrying the address to be printed so that the address is printed at a desired position on the workpiece being fed.

The above-mentioned address printer prints an address by applying a copying liquid at the printing position of the workpiece, placing a master card over it, and applying pressure thereon. The master cards are piled up in a card feed tray and are delivered one by one onto the workpieces by master card delivery means. The printing position for different workpieces may change depending on the size of the workpieces and other factors. Accordingly, it is necessary that the delivery phase of the master card be adjustable in accordance with the location of the printing position. To achieve such phase adjustment, conventional address printers have adjustably synchronized the operation of the workpiece feed means and the master card delivery means by use of adjusting means including such electrical means as a limit switch and timer. Incorporated with an electric system, such adjusting means have been complex in structure, developed many troubles, and necessitated much maintenance.

The object of this invention therefore, is to provide print position adjusting means for an address printer which adjusts the operating phase of the workpieces feed means and the master card delivery means with simple mechanical means, thus freed of the aforesaid shortcomings.

For a better understanding of the invention disclosed herein, reference is made to the following description of a preferred embodiment taken in conjunction with the figures of the accompanying drawings in which.

Figure 1:
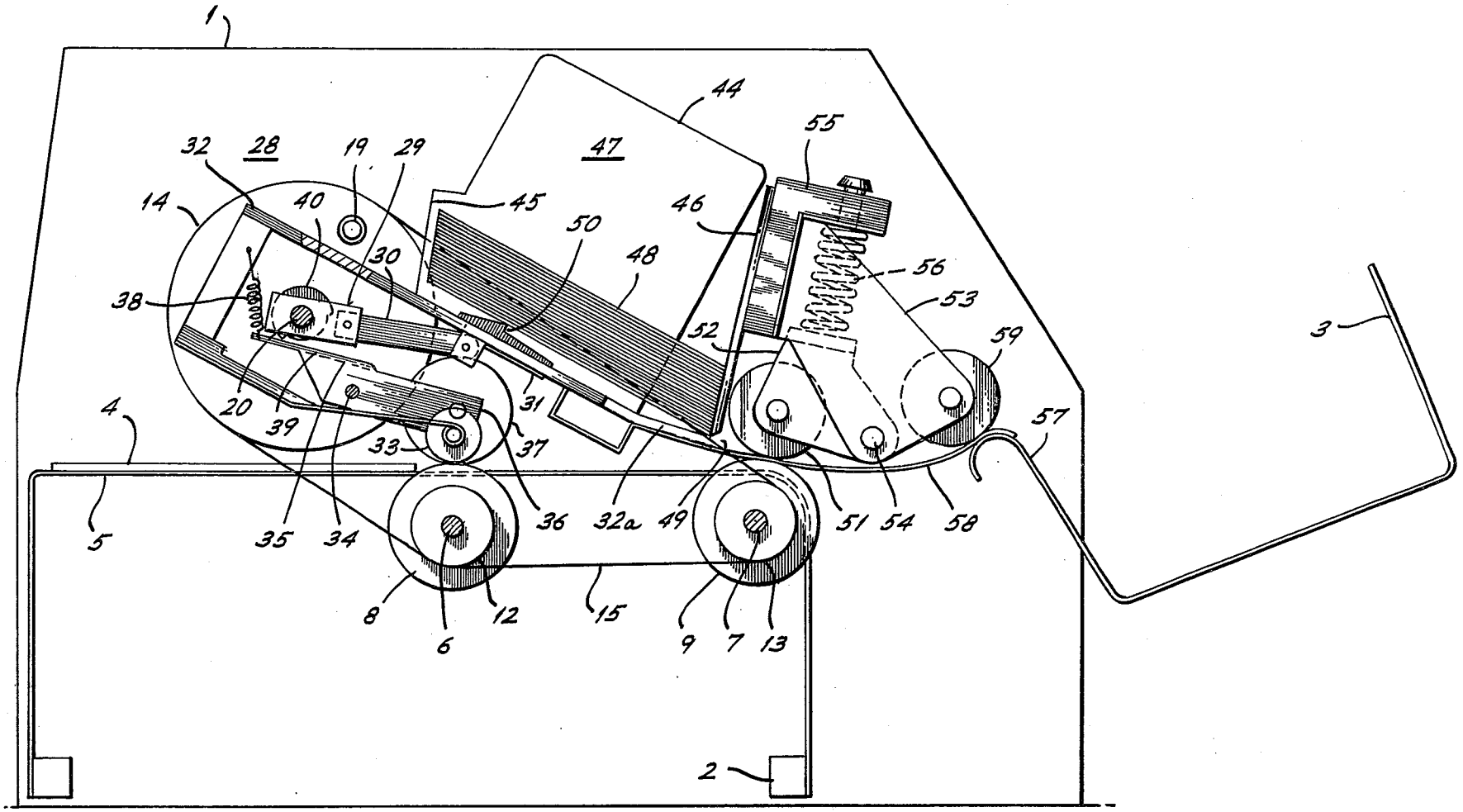
FIG. 1 is a cross-sectional view showing a preferred embodiment of an address printer in accordance with this invention.

Referring to FIG. 1, an address printer is illustrated and is supported on a frame 2 enclosed in a housing 1, with a card receiving tray 3 to receive master cards being provided in front of the frame 2. A workpiece 4 on which printed material is to be printed, such as an envelope or postal card to be mailed, is supplied one by one from the left onto a supply table 5. The workpieces can be fed by hand or by conventional feeding apparatus which need not be described here.

Figure 2:
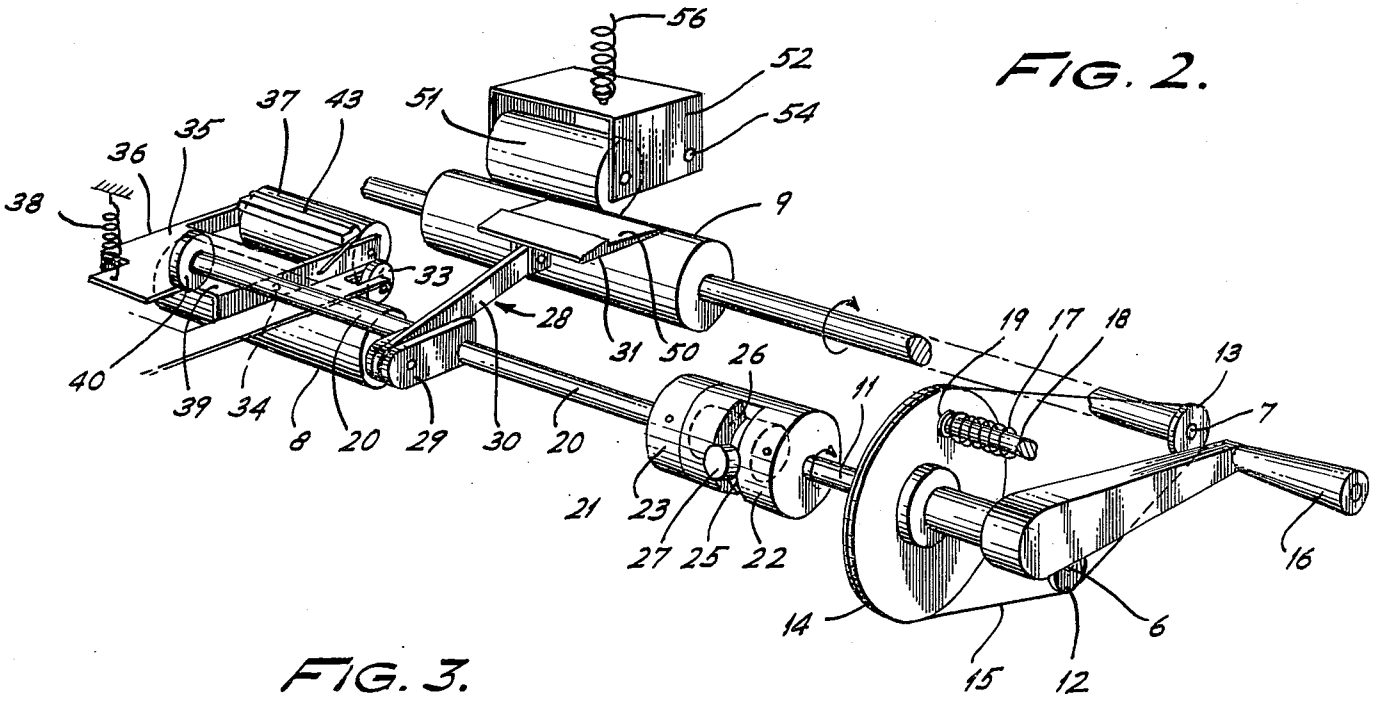
FIG. 2 is a perspective view illustrating adjusting means and associated apparatus illustrated in FIG. 1.

Using suitable bearings, shafts 6 and 7 are rotatably mounted between opposite frame side plates 2*a*. The shafts are positioned below the supply table, the shaft 6 at the middle and the shaft 7 at the forward end. The shafts 6 and 7 carry a feed roller 8 and a print roller 9, respectively, both protruding slightly above the supply table 5. A drive shaft 11, positioned above the supply table 5 and parallel to the shafts 6 and 7, is rotatably supported in a bearing provided on one of the side plates 2*a* (FIG. 2). A chain 15 is engaged with sprockets 12, 13 and 14 fixed at one end of the shafts 6, 7 and 11, respectively, so that the shafts 6, 7 and 11 can be synchronously rotated in the direction of the arrow by turning a handle 6. The feed and print rollers 8 and 9 have the same diameter, as do the sprockets 12 and 13, but the sprocket 14 is larger in diameter than the sprockets 12 and 13. A pin 18 is passed against one side of the sprocket 14 by a spring 17. The shaft 11 is in its start position when the pin 18 fits into a recess 19 formed on the sprocket 14 and this start position can be perceived by an increase in resistance to the rotation of the handle 16 which occurs when the sprocket 14 passes that position. When the start position is perceived it will be recognized that the machine is ready to start a print cycle and the shaft 11 can be retained in this position until it is desired to start a print cycle.

Figure 3:
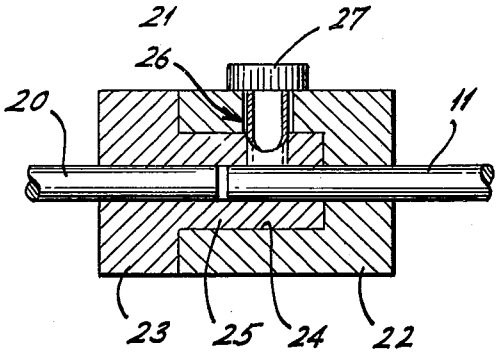
FIG. 3 is a longitudinal cross-sectional view of the adjustable coupling illustrated in FIG. 2; and, FIG. 4 is a schematic view illustrating a cam usable with this invention and illustrated in FIGS. 1 and 2.

The frame 2 carries an operating shaft 20, which is coaxial with the drive shaft 11 and the shafts 11 and 20 are joined together by a coupling 21 which allows for the adjustment of the shafts relative to each other. As shown in FIG. 3, the coupling 21 comprises connecting members 22 and 23 fixed to the shafts 11 and 20, respectively. The connecting member 23 is formed with a projection or tenon 25 and the connecting member 22 is formed with a complimentary recess or mortise 24. The tenson 25 is rotatably fitted in the mortise 24. Formed in the connecting member 23 is a cylindrical opening which receives both the operating shaft 20 and the driving shaft 11, the latter shaft extending through a coaxial cylindrical opening formed in the connecting member 22. A set-screw 27 is screwed into the tenon 25 through an elongated generally arcuate slot 26 formed in the connecting member 22, thereby fastening together the members 22 and 23. By loosening the set-screw 27, changing the relative angular position of the connecting members 22 and 23, and retightening the set-screw 27, the connecting angle of the shafts 11 and 20 can be adjusted as desired.

Master card delivery means 28 is provided and has a feed pawl 31 connected through an arm 30 to a crank 29 fixed to the operating shaft 20 at the middle thereof. The feed pawl 31 is thus reciprocated by the crank 29 and arm 30 along a guide groove in a fixed plate 32 attached to the frame 2, with its forward end inclined downwardly toward the supply table 5.

After stopping the handle 16 in the start position perceived when pin 18 fits into recess 19, the workpiece 4 is supplied to the supply table 5 and positioned so that its forward end comes into contact with the feed roller 8. On turning the handle 16 in the direction of the arrow, the feed roller 8, together with a pair of pinch rollers 33 spring-urged against both ends of the feed roller, conveys the workpiece 4 to the right as viewed in FIG. 1. Between the pair of pinch rollers 33, an oscillation plate 35 is pivotally mounted on the frame 2 by a pin 34. The vertical walls 36 on both sides of the oscillation plate 35 rotatably carry a copying liquid application roller 37 at their forward ends. At the rearward end of the oscillation plate 35 there is fixed one end of a spring 38 connected at its other end so that the spring pulls the rearward end of the oscillation plate upwardly about the pin 34 whereby the copying liquid application roller 37 contacts the middle upper surface of the feed roller 8.

Figure 4:
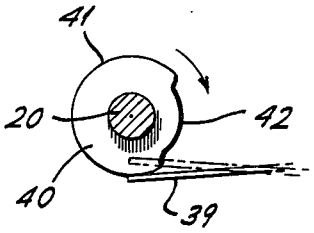

The oscillation plate 35 is pressed downwardly about the pin 34 and against the pulling force of the spring 38 by a contiguous cam 40 fixed at the remotest end of the operating shaft 20 and which bears on the back portion 39 of the plate. As illustrated in FIG. 4, the cam 40 includes a large-diameter portion 41, having a circumferential extent of approximately 210°, and a small-diameter portion 42, having a circumferential extent of approximately 150°. When the back portion 39 is in contact with the large-diameter portion 41, the back portion is pivoted downwardly about the pin 34 and liquid application roller 37 is held apart from the feed roller 8. As the cam 40 turns in the direction of the arrow and the small-diameter portion 42 contacts the back portion 39 of the oscillation plate 35, the spring 38 is operative to pull the back portion upwardly about the pin 34 so that the liquid-application roller 37 is pressed against the feed roller 8.

A copying liquid supplied from a liquid supply device 43 fitted to the oscillation plate 35 spreads over the entire surface of the liquid-application roller 37. When the liquid-application roller 37 comes in contact with the predetermined print position of the workpiece 4 being fed by the feed roller 8 and pinch rollers 33, the copying liquid is applied thereto.

Above the fixed plate 32 is provided a card feed tray 47 which consists of a pair of master card guide plates 44, an inclined plate 45 at the back and a throat knife 46 at front, and contains a stack of master cards 48 carrying addresses to be printed. A slightly up-bent throad ramp **32*a* is attached to the forward end of the fixed plate 32 and a delivery slot 49, through which the master cards 48 are discharged one by one, is formed between the forward end of said throat ramp 32*a* and the lower end of the throat knife 46. The feed pawl 31 reciprocated by the crank 29 and arm 30 discharges one master card 48 after another through the delivery slot 49, by use of a shoulder 50 which engages the lowermost card 48 in the stack and which pushes it through the slot as the feed pawl is reciprocated along the plate 32**.

Ahead of the throat knife 46, a print roller 51 is rotatably supported on a support frame 52 so as to come into contact with the upper surface of another print roller 9. The support frame 52 is provided to a fixed frame 53 about a pin 54 carried on the fixed frame. The print roller 51 is pressed against the print roller 9 by a compression spring 56 interposed between a stop member 55 to which the fixed frame 53 is attached and the upper portion of the support frame 52.

A master card guide means 58 is provided from below the forward end of the fixed plate 32 to over the upper end of the nearer wall 57 of the card receiving tray 3. The guide means 58 consists of three metal strips which are spaced from each other and from the print rollers 9 and 51 and are slightly curved downwardly so that they pass the level at which the print rollers 9 and 51 contact. A discharge feed roller 59 operated by a belt passed over the shaft of the print roller 51, bears on an arcuate surface on the nearer wall 57 and discharges the master cards into the tray 3.

The workpiece 4 is fed by the feed roller 8 to the print roller 9, after being applied with the copying liquid by the liquid-application roller 37 during its travel. The master card delivery means 28 discharges a master card 48 through the delivery slot 49, operating in a certain phase relation with the liquid applying motion of the liquid-application roller 37.

The master card 48 and the workpiece 4 are in overlying relationship with each other as they feed between the print rollers 9 and 51. At this time, the address is printed at the desired position of the workpiece 4, if the operation of the delivery means 28 and of the liquid-application roller 37 is properly adjusted with respect to the movement of the workpiece 4 so that the address portion of the master card 48 comes over the liquid-applied portion of the workpiece 4.

After the address has been printed on the workpiece, it is discharged from the forward end of the supply table 5, while the master card 48 is discharged over the guide means 58 and falls into the card receiving tray 3.

The feed of the master card 48 in relation to the feed of the workpiece 4 will have to be adjusted depending on the size of the workpiece, the desired printing position, and other factors. According to this invention, this adjustment is effected by changing the relative position of the connecting members 22 and 23 and thus the relative position of the drive shaft 11 and operating shaft 20. By changing the position of the operating shaft 20 relative to the drive shaft 11, the operation of the card delivery means 28 and of the liquid-application roller 37 relative to the feed of the workpiece 4 is adjusted, thus adjusting the location of the print position.

To be more precise, the feed of the workpiece 4 is established by the rotation of the shaft 6 and, of course, of the drive shaft 11, and the feed of the master card 48 by the rotation of the operating shaft 20. Accordingly, the address can be printed at the desired position of the workpiece 4 if the position of the operating shaft 20 at the start of the print cycle is adjusted relative to the position of drive shaft 11 at the start of the print cycle by adjusting the coupling 21.

As will be understood from the above, this invention permits easy adjustment of the desired printing position on the workpiece by use of simple mechanical means. Print position adjusting apparatus of this invention is not only easy to handle and maintain but also substantially trouble-free.

I claim:

1. A printer comprising roller means for feeding a workpiece on which printed material is to be printed, liquid application roller means for applying a copying liquid on the workpiece being fed, delivery means for delivering a master card on which the printed material is contained, and a pair of print rollers to which said workpiece and said master card are delivered for printing the printed material from the master card to the workpiece, a drive shaft for rotating said roller means and an operating shaft, said operating shaft operatively arranged to operate the said liquid application roller means and said delivery means, and coupling means adjustably coupling said drive shaft to said operating shaft, said coupling means including a first connecting member fixed to said drive shaft and a second connecting member fixed to said operating shaft, one of said connecting members being formed with a tenon and the other of said connecting members being formed with a mortise in which said tenson is rotatably received whereby said first and second connecting members are adjustable for adjusting said drive shaft relative to said operating shaft, said one of said connecting members being formed with a threaded opening and the other of said connecting members being formed with an elongated slot and a set screw received in said slot and said threaded opening for securing said connecting members in an adjusted position whereby said drive shaft and said operating shaft can be fixed in an adjusted position.

* * * * *